US005117597A

United States Patent [19]

Feller

[11] Patent Number: 5,117,597

[45] Date of Patent: Jun. 2, 1992

[54] ROOF VENT PIPE COLLECTION DEVICE

[76] Inventor: David L. Feller, 2640 Vancouver St., Carlsbad, Calif. 92008

[21] Appl. No.: 587,104

[22] Filed: Sep. 24, 1990

[51] Int. Cl.[5] ..... E04H 12/28; F23J 13/04

[52] U.S. Cl. ..... 52/199; 126/317; 52/302; 52/726

[58] Field of Search ..... 52/199, 726, 302, 58, 52/218, 219; 126/314-317; 285/13, 42, 178; 4/209, 211, 218; 98/19, 40, 42, 66

[56] References Cited

U.S. PATENT DOCUMENTS

| | | | |
|---|---|---|---|
| 446,685 | 2/1891 | Jacobs | 126/317 |
| 538,603 | 4/1895 | Simpson | 52/169.5 |
| 631,185 | 8/1899 | Sherwin | 126/317 |
| 799,982 | 9/1905 | Graham | 126/314 |
| 1,263,789 | 4/1918 | Morrison | 52/302 |
| 2,471,708 | 5/1949 | White | 285/42 |

*Primary Examiner*—James L. Ridgill, Jr.
*Attorney, Agent, or Firm*—John J. Murphey

[57] ABSTRACT

A roof vent pipe leak collection device comprising a surface extending outwardly and upwardly from the outer surface of the vent pipe and terminating below the roof, the surface defined by a lower end, arranged in water-tight engagement with the outer surface of the vent pipe, and a wider, upper end spaced-apart therefrom; the surface further defining an open-topped cavity exterior of the roof vent pipe to collect drops of liquid falling from above and liquid running down the outer surface of the vent pipe, and at least one aperture formed in the wall of the roof vent pipe, entering from the outside thereof in the cavity and opening into the interior of the vent pipe a spaced distance above the entrance to convey liquid collected in the cavity into the interior of the vent pipe while inhibiting the escape of gas and fumes therefrom.

12 Claims, 2 Drawing Sheets

ROOF VENT PIPE COLLECTION DEVICE

BACKGROUND OF THE INVENTION

1. Field Of The Invention

This invention pertains to the construction industry. More particularly, it pertains to a unique device for use with a roof vent pipe or other tubular member extending vertically through a roof, to capture water or other liquid dripping through a failed or loose vent pipe flashing/seal into the interior of the structure, to re-direct the captured liquid into the vent pipe before it can do any harm to the walls or other interior portions of the structure.

2. Description Of The Prior Art

Vent pipes are hollow tubular members that extend generally vertically upward in the walls of a structure through the roof to terminate above the roof line. The lower part of the vent pipe is connected either directly or through a manifold system to various sewer pipes, drains and water closets. The primary purpose of a vent pipe is to relieve pressure or suction and to transfer noxious odors, that are generated in the sewers, drains and water closets, above the roof line for discharge in the wind before they can become an insult to the sensory organs.

Roof vent pipes normally exit the structure through the roof as opposed to exiting the side walls and extending up along the wall to the roof line. The roofs through which the vent pipes extend may be flat or pitched. In virtually all cases, the roof aperture through which the vent pipe extends is sealed against the influx of rain or melting snow to prevent that liquid from running down the outside of the walls of the vent pipe to invade insulation or spill onto interior walls and stain them. In addition to stairs, the influx of liquid down through the opening through which the vent pipe passes will also establish a damp environment that could support the growth of mildew and the buildup of noxious odors that could find their way into the interior of the structure.

The prior art has concentrated on improving the type of seal or flashing that is used on the outside of the vent pipe and the outside of the roof. U.S. Pat. Nos. such as 1,538,924; 1,540,192; 2,985,465; 4,160,347; 4,437,687; and, 4,563,847; show prior art attempts to prevent the influx of water through these apertures. For the most part, these prior art devices either have not solved the water influx problem or are so complicated that their cost of fabrication and/or installation is excessively expensive thereby preventing general acceptance in the construction industry. Even further, it is difficult to stop the influx of water through a seal or flashing that is exposed to extremes in temperature, between day and night and winter and summer, as well as to develop a usable seal that is inexpensive and easy to install or that does not degrade when exposed to sun, acid rain and smog. Accordingly, there is still a need for a long-lasting, inexpensive and easy-to-install roof vent pipe leak collection device.

SUMMARY OF THE INVENTION

The instant invention cures all of the problems that are associated with the prior art devices. It is an inexpensive collection device that is easy to install, either as original equipment or to be retro-fitted on existing roof vent pipes. The device of this invention works on the principal of collecting the water and other liquid that influxes from above the roof, instead of sealing it out, and thereafter directing it into the interior of the roof vent pipe for evaporation by the rising gases in the pipe or discharge in the lower sewer. This inventive device allows the passage of water and other liquid captured from above into the interior of the roof vent pipe without, the same time, allowing the escape of noxious fumes from inside the vent pipe to outside the pipe.

This invention generally comprises a surface, terminated by spaced-apart ends, that is arranged about the outer surface of the vent pipe with the smaller, lower end of the surface placed in water-tight engagement with the outer surface of the vent pipe. The surface then extends upwardly and outwardly from the vent pipe to define an open-topped cavity exterior the vent pipe to collect the dripping liquid from above and the liquid that runs down the outer surface of the vent pipe that have influxed into the interior of the structure through a failed roof vent pipe seal or flashing.

At least one and preferably a plurality of apertures is formed in the wall of the roof vent pipe entering from inside the cavity and slanting upward to open into the interior of the vent pipe. Water collected in the cavity rises in these apertures and forms hydraulic seals to prevent escape of the noxious fumes from interior the vent pipe while at the same time, the reverse slant of the apertures provides resistance to the escape of gas and noxious fumes from interior the vent pipe. In one embodiment of this invention, the device is mounted on a pipe stub and a sleeve is used to seal the stub in a cut-out portion of an existing roof vent pipe so as to render the invention usable as a retrofit to existing roof vent pipes.

Accordingly, the main object of this invention is a roof vent pipe leak collection device that does not depend upon the integrity of the roof flashing or seal to stop the influx of liquid from the roof. Other objects of the invention include a small, inexpensive and easily installed device for retro-fit in an existing roof vent pipe assembly without need to replace the roof seal; a device that allows water dripping from above the vent pipe to be captured and directed to the interior of the vent pipe without simultaneously releasing noxious fumes into the structure; and, an inexpensive means of preventing further degradation of the plaster wall surfaces interior the structure or generation of mildew and other derogatory materials by the continued influx of water through a failed roof gasket. These and other objects of the invention will become more apparent when reading the following description of the preferred embodiments taken together with the drawings appended hereto. The scope of protection sought by the inventor may be gleaned from a fair reading of the claims that conclude this specification.

DESCRIPTION OF THE PREFERRED EMBODIMENT

Figure 1:
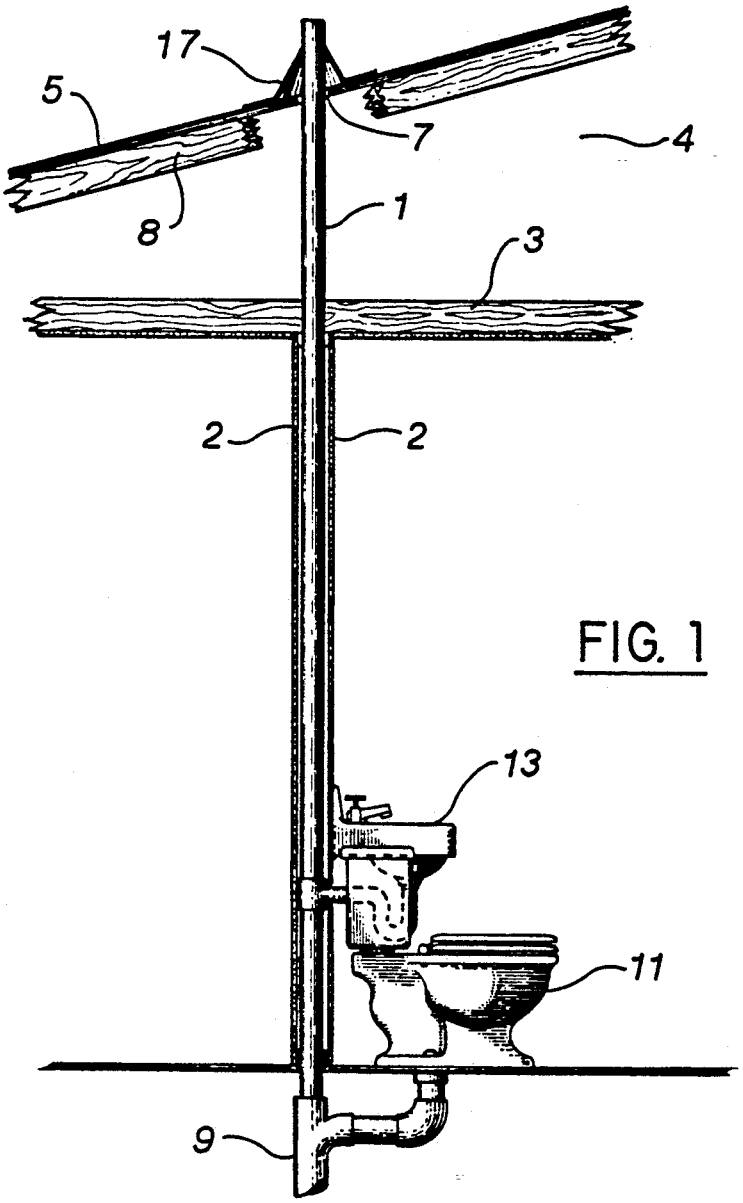
FIG. 1 is an illustrative view of a typical vent pipe installation in a structure showing it connected to a typical sewer and other devices and extending upward through the roof to the exterior of the structure.

Referring now to the figures where like elements are identified by like numerals throughout the three figures. FIG. 1 shows a typical installation of a roof vent pipe 1 extending upward between walls 2 of a structure through a set of ceiling rafters 3 into an attic 4 and exiting the roof 5 through an aperture 7 formed between and above roof rafters 8. The lower end of vent pipe 1 is connected to a typical sewer drain 9, which drains a typical flush toilet 11 and wash basin 13 vent pipe 1 is totally open to the atmosphere at its upper end 15. As shown, roof vent pipe 1 is sealed at its exit point through roof aperture 7 by a typical sealing gasket or flashing 17.

Figure 2:
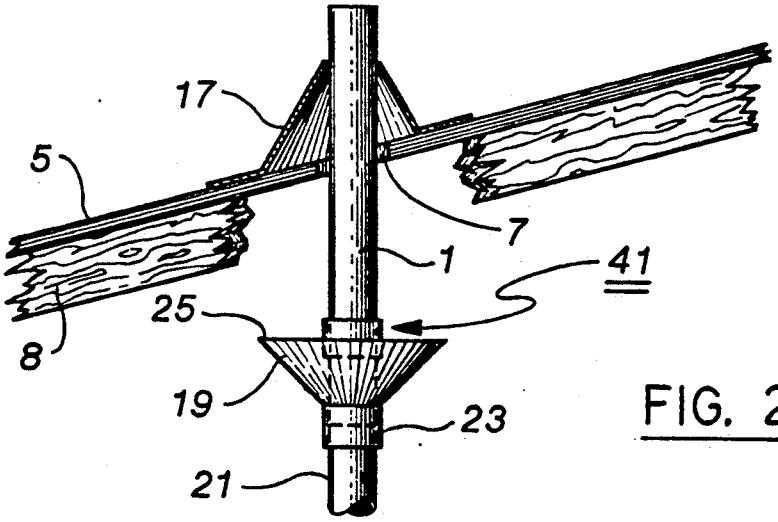
FIG. 2 shows a side view of one embodiment of the roof vent pipe leak collection device of this invention.
Figure 3:
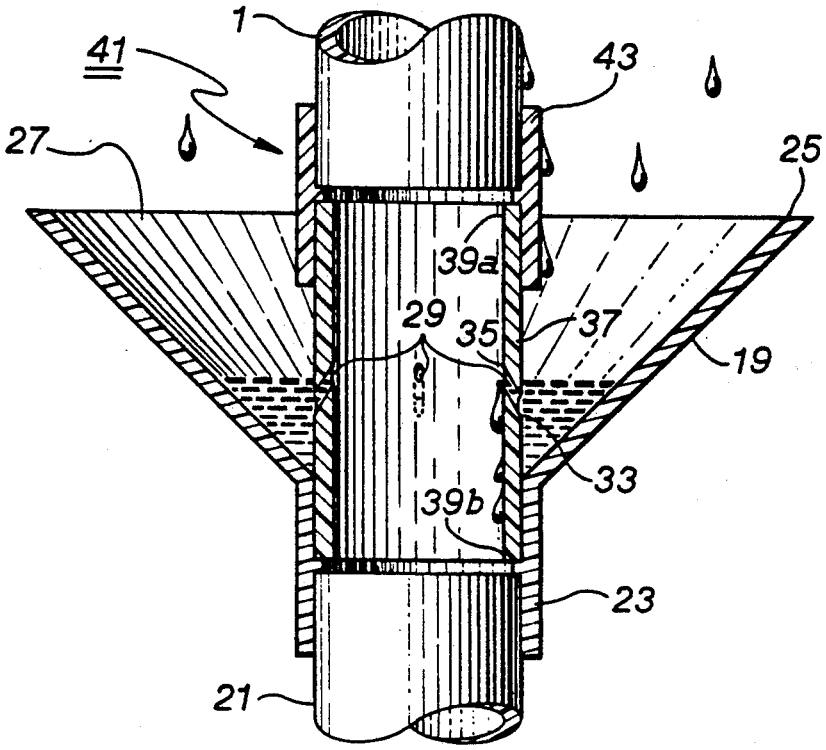
FIG. 3 is a close-up side elevational view taken of the embodiment shown in FIG. 2; and, FIG. 4 is a sectional side view of another embodiment of this invention.
Figure 4:
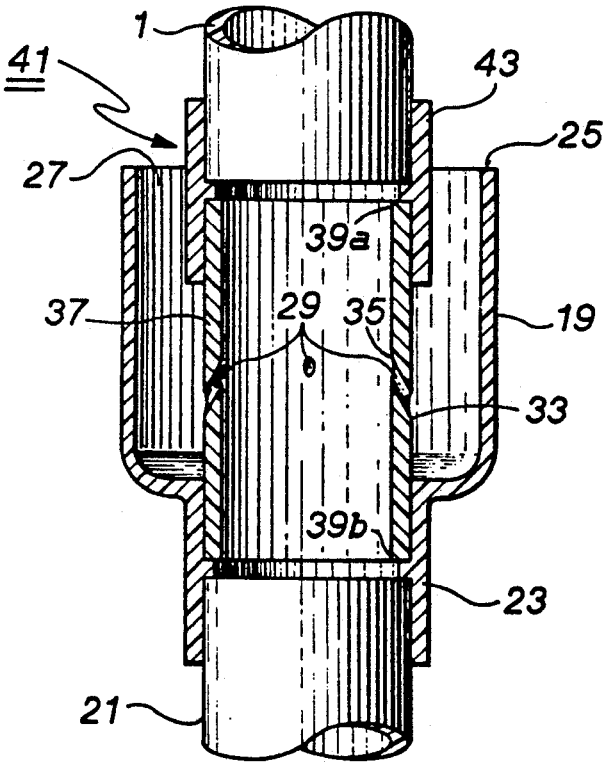

Turning now to the other figures, this invention is shown to be comprised of a surface 19 extending upwardly and outwardly from the outer surface 21 of vent pipe 1 terminating below roof 5. Surface 19 is defined by a lower, smaller diameter end 23 arranged in water-tight engagement with vent pipe 1 and an upper end 25 spaced apart and above lower end 23. Surface 19 may be U-shaped, as shown in FIG. 4, or frusto-conical (a frustum) as shown in FIGS. 2 and 3.

Surface 19 is up-ended or, in other words, arranged so that upper, larger diameter end 25 is above lower, smaller diameter end 23 to form an open-topped cavity 27 about roof vent pipe 1. While it is desirable to arrange cavity 27 concentric with vent pipe 1, there would be times when, due to the closeness of pipe 1 to a wall, etc., such concentricity is not obtainable. As shown in FIGS. 2, 3, and 4, lower surface end 23 is placed in water-tight engagement with the outer surface 21 of roof vent pipe 1 and such a seal is made entirely around the outer surface of vent pipe 1 to prevent passage of liquid therethrough. Such a connection may be done mechanically, such as by placing a tight clamp about the outer portion of surface 19 adjacent its lower end 23. However, it is more convenient and is preferred as an embodiment of this invention to have vent pipe outer surface 21 and lower surface end 23 of surface 19 made as one piece such as by integrally molding them together. They may also be glued together as one piece. Where vent pipe 1 and surface 19 are fabricated from compatible plastics, such as polyvinyl chloride, polystyrene or acrylonitrile-butadienestyrene (ABS) plastics, there are a number of known adhesives readily available on the market that may be used to form the seal therebetween. In cavity 27 are collected drops of liquid that enter through roof aperture 7 through which roof vent pipe 1 passes exterior the structure. In addition, water or other influxing liquid that does not drip through roof aperture 7 may run down the outer surface 21 of vent pipe 1 and the same is also capture in cavity 27.

At least one, but preferably a plurality of apertures or bore holes 29 is formed in vent pipe wall 31 and is slanted upwardly and inwardly through pipe wall 31. "Upwardly and inwardly slanted" means that bore 29 begins at a first aperture 33 formed in the outside surface of pipe wall 31 in cavity 27 and preferably near the bottom thereof, and then bore 29 slants upwardly and inwardly through the wall of flue vent pipe 1 to open into the interior of pipe 1 at an exit 35, a space distance above first aperture 33. The purpose of bore 29 is to allow the passage of water and liquid collected in cavity 27, as shown in FIG. 3 and 4, to pass upward, then drip down into the interior of vent pipe wall 31 to be carried away by the lower sewer drain. As shown, the rising liquid in apertures 29 forms a barrier to the passage of sewer gas and noxious odors from interior roof vent pipe 1 to exterior thereof. Even where the level of the liquid is below bores 29, the fact that they have an inwardly and upwardly slant as they progress toward the interior of the vent pipe 1 establishes resistance that prevents the exiting of sewer gas and noxious fumes form interior vent pipe 1. The temperature in the attic is normally higher than the outside temperature and this differential also provides resistance to the escape of fumes and odors through apertures 29.

It is preferable that surface 19 be arranged concentric with roof vent pipe 1 to collect falling drops of liquid equally about vent pipe 1. However, there are occasions when a particular pattern of dripping is noticed that is more to one side of the vent pipe than another and accordingly surface 19 may be tilted or extended in the direction of that known drip to provide for greater capture of that particular concentration of drips. For these and other reasons, surface ends 23 and 25 may not necessarily always be set parallel; however, arranging them parallel is the preferred embodiment herein.

Where this invention is to be retro-fitted into an existing vertical roof vent pipe, a section of pipe 1 may be cut out such as by the use of a saw. Thereafter, as shown in FIGS. 3 and 4, a hollow stub 37 of the same length and diameter as that cut out is provided and defined by spaced-apart stub ends 39*a* and 39*b*. Stub 37 is preferably made of the same length as the cut out portion so that stub ends 39*a* and 39*b* respectively contact the free ends of roof vent pipe 1 adjacent the cut out portion. Surface 19 is then arranged as shown in FIGS. 3 and 4 substantially intermediate stub 37, preferably substantially intermediate stub ends 39*a* and 39*b* and preferably concentric therewith, again having lower surface end 23 at the lower portion of surface 19 and in water-tight engagement with pipe outer surface 21 of stub wall 37.

Means 41 are provided to secure hollow stub 37 in concentric alignement with roof vent pipe 1. Means 41 may be selected from a wide variety of pipe connection devices including threaded fittings such as unions and sleeves. Preferred, where vent pipe 1 is made of plastic, is at least one close-fitting sleeve 43, having an inside diameter the same as the exterior diameter f roof vent pipe 1 that is arranged for sliding over the joint between stub end 39*a* and thereafter sealed by the use of adhesives, such as polyvinyl chloride adhesive in case of PVC pipe, ABS adhesive in the case of ABS pipe, etc., in order to seal the top of hollow stub 37 therein in concentric alignment with existing vent pipe 1. The bottom end 39*b* of stub 37 may be likewise sealed in concentric alignment with roof vent pipe 1 by forming a partial sleeve 45 at lower surface end 23 for passing over the lower end of vent pipe 1 as shown in FIGS. 3 and 4.

What is claimed is:

1. Roof vent pipe leak collection device comprising:

a) a surface extending outwardly and upwardly from the outer surface of the vent pipe and terminating below the roof, said surface defined by a lower end, arranged in water-tight engagement with the outer surface of the wall of the vent pipe, and a wider, upper end spaced-apart therefrom;

b) said surface further defining an open-topped cavity exterior of the roof vent pipe to collect drops of liquid falling from above and liquid running down the outer surface of the vent pipe; and, c) said vent pipe wall having formed therethrough at least one bore, beginning at a first aperture formed in said vent pipe outer wall surface, said bore slanting upwardly and inwardly to a second aperture formed in said vent pipe inner wall surface, said second aperture spaced above said first aperture allowing said bore to convey liquid collected in said cavity up into the interior of said vent pipe while inhibiting the escape of gas and fumes from inside said roof vent pipe.

2. The roof vent pipe leak collection device of claim 1 wherein said spaced-apart ends of said surface are arranged mutually parallel.

3. The roof vent pipe leak collection device of claim 1 wherein said surface is arranged concentric about the outer surface of the vent pipe.

4. The roof vent pipe leak collection device of claim 1 including a plurality of apertures.

5. The roof vent pipe leak collection device of claim 1 wherein said surface is in the form of a frustum.

6. Roof vent pipe leak collection device comprising:

a) a hollow stub defined by spaced-apart stub ends for in-line concentric assembly with the vertical roof vent pipe;

b) a surface extending outwardly and upwardly from the outer surface of said stub and terminated by spaced-apart ends, arranged substantially intermediate said stub ends, having a lower end adapted for water-tight engagement with the outer surface of the vent pipe;

c) said surface defining an open-topped cavity exterior of said stub to collected drops of liquid falling from above and liquid running down the outer surface of the vent pipe;

d) the wall of said stub having formed therethrough at least one bore, beginning at a first aperture formed in said stub outer wall surface, said bore slanting upwardly and inwardly to a second aperture formed in said stub inner wall surface, said second aperture spaced above said first aperture allowing said bore to convey liquid collected in said cavity upward into the interior of said vent pipe while inhibiting the escape of gas and fumes form inside said roof vent pipe; and, e) means for retaining said stub in vertical sealed alignement with the vent pipe.

7. The roof vent pipe leak collection device of claim 6 wherein said spaced-apart ends of said surface are arrange mutually parallel.

8. The roof vent pipe leak collection device of claim 6 wherein said surface is arranged concentric about the outer surface of said stub.

9. The roof vent pipe leak collection device of claim 6 including a plurality of apertures formed in said stub.

10. The roof vent pipe leak collection device of claim 6 wherein said surface is in the form of a frustum.

11. The roof vent pipe leak collection device of claim 6 wherein said means for retaining said stub in vertical sealed alignment with the roof vent pipe includes at least one sleeve for overlaying the joint between the upper end of said stub and the end of the vent pipe to which it is joined.

12. The roof vent pipe leak collection device of claim 6 wherein said means for holding said stub in vertical sealed alignment with the roof vent pipe includes a sleeve formed integral with said lower surface end for overlaying the joint between said lower end of said stub and the joined end of the vent pipe to which it is joined.

* * * * *